United States Patent [19]

Anderson

[11] 4,180,245

[45] Dec. 25, 1979

[54] MECHANICAL FENCING MACHINE

[76] Inventor: Colin C. Anderson, 6 Montrose Pl., Beaumont, Australia, 5066

[21] Appl. No.: 897,258

[22] Filed: Apr. 18, 1978

[30] Foreign Application Priority Data

Apr. 19, 1977 [AU] Australia ..... PC9798

[51] Int. Cl.[2] ..... B66F 3/00

[52] U.S. Cl. ..... 254/64; 254/83

[58] Field of Search ..... 254/64, 83, 134.3 R; 29/452; 256/1, 2, 11, 37, 39; 242/860 R; 140/123.5

[56] References Cited

U.S. PATENT DOCUMENTS

| | | | |
|---|---|---|---|
| 3,104,863 | 9/1963 | De Forest | 254/64 |
| 3,201,085 | 8/1965 | Maley | 254/83 |
| 3,722,861 | 3/1973 | Anderson | 254/64 |

*Primary Examiner*—Robert C. Watson

*Attorney, Agent, or Firm*—Oldham, Oldham, Hudak & Weber Co.

[57] ABSTRACT

A fencing machine where a tensioned fence with posts or droppers attached is laid along the fence line. The machine tensions the wires and by deflecting the wire inserts the deflected wires into offset slots in the posts or droppers.

9 Claims, 8 Drawing Figures

MECHANICAL FENCING MACHINE

This invention relates to mechanical fencing, and more particularly to a portable fencing machine, which is adapted to lay a tensioned wire fence supported by posts.

BACKGROUND OF THE INVENTION

Portable fencing devices are known such as disclosed in U.S. Ser. No. 3,722,861 which can comprise a transport means such as a truck or tractor, the truck carrying a reel of wire and braking means to tension the wire fed from the reel, with the braking adjusted by varying spring tension. The truck also carries driving means to drive posts into the ground, these being situated rearwardly of the braking means so that when the wire is anchored on an anchor post along the fence line, movement of the truck along the fence line causes the wire to be fed out under predetermined constant tension, which is maintained by the braking means, and the post driving means that drives the posts into the ground along the line of the tensioned wire for attachment to the tensioned wire.

In this machine the posts are driven into the ground along the fence line, and the tensioned wires are then kinked or otherwise clipped into the notches formed in the posts, it being realised of course, that preferably the posts are metallic V-sectioned posts, with off-set notches in the edges of the arms of the V, so that the tensioned wires are then clipped and locked in position on the post to thus assist in stabilising the posts due to this locking on the tensioned wire.

However, this attachment and clipping of the kinked wire on to the post after the posts have been driven into the ground, and while the wire is in a highly tensioned state, is a difficult operation, and also is a manual operation which has to be carried out thus causing extra time to be used in the erection of the fence.

Various proposals have been put forward for attaching the posts to the wires before they are driven into the ground, but no satisfactory method has been devised as far as the applicant is aware.

Thus it is an object of this invention to provide improved means for a mechanical or fencing machine to attach the posts to the wires before they are driven into the ground.

BRIEF DESCRIPTION OF THE INVENTION

According to the invention, the posts are clipped on to the wires while the wires are under a low or pretensioned condition, before the wires are finally tensioned to their desired level.

In this way the wires are pretensioned, and the post is then positioned adjacent the wires, and the wires are then kinked or deflected to allow the post to be moved to allow the wires to enter the slots, and on release of the force to kink or deflect the wires, the posts are then locked to these wires. The wires and posts then travel through the final tensioning means and the posts can then be driven into the ground with the wires tensioned and locked therein.

In a preferred form the wires can be fed from respective wire reels, the wire being fed through pretensioning rollers, to pass to the final tensioning rollers. During this movement, the wires are arranged so that they are in a generally horizontal plane and are spaced the required distance apart. The posts are stacked and arranged horizontally across beneath the wires, and a lifting or grab means is adapted to lift the uppermost post up and hold it against the wires.

While in this position, the wire is kinked or deflected in the direction of offset of the slots or notches in the post, so that the upward force on the post would allow the post to thus raise further and engage the wire in the notches. On release of the deflecting means, the post is then locked to the wire, and the post is then disengaged from its lifting means, and passes with the wires through the tensioning rollers. Preferably the tensioning rollers have co-operating helically fluted engaging portions to pull the wire through the rollers, with the rollers and the flutes being so shaped and indexed that the post would pass through the shaped flutes with the tensioned wires.

The deflecting means for the wires can include a pair of depending pegs for each wire, each peg of each pair being mounted on a separate rod or bar, and means are provided for causing these two bars to move in opposite directions, so that the pegs thus move to deflect the wires.

BRIEF DESCRIPTION OF THE DRAWINGS

In the drawings

FIG. 7 shows a lifting platform to hold and present the post to the wires, and the mechanism for quickly disengaging the deflecting pegs.

DESCRIPTION OF THE PREFERRED EMBODIMENT

Figure 8:
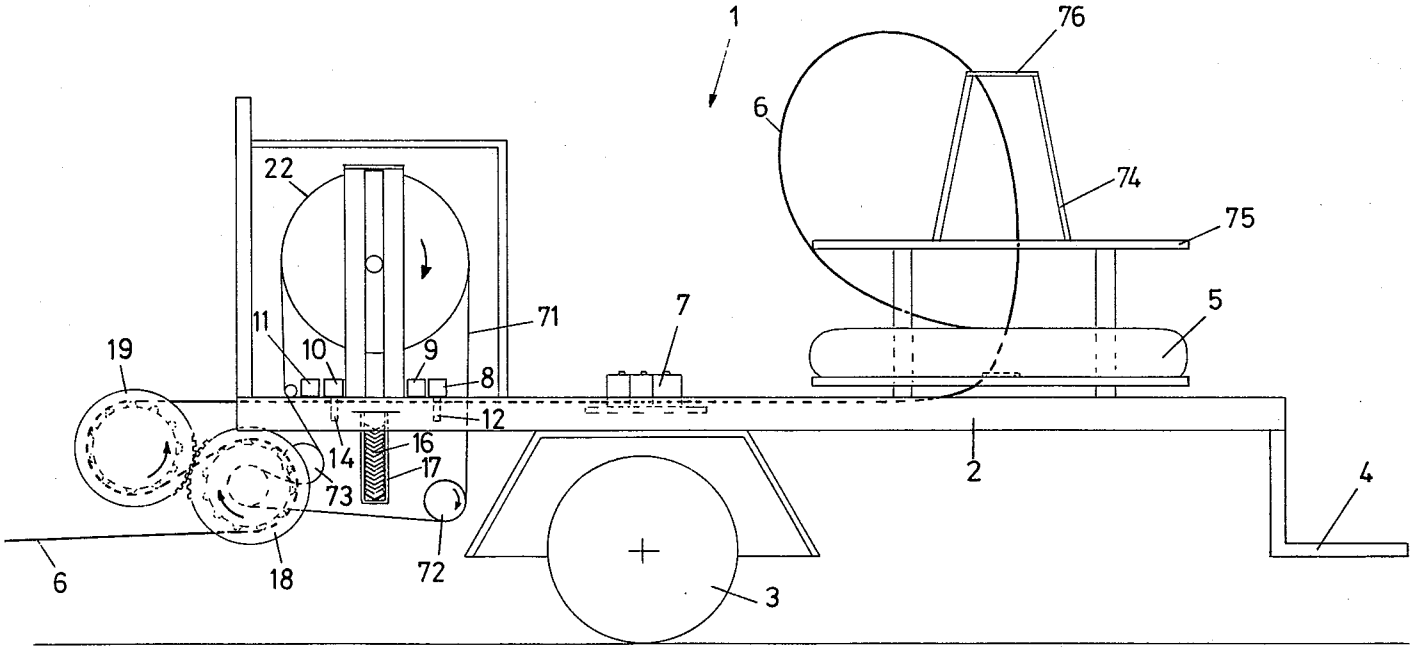
FIG. 8 is a side view of the machine.

Referring firstly to FIG. 8 of the drawings, the machine 1 is mounted on a trailer frame 2 having wheels 3 and a draw bar 4 for towing from a powered vehicle, such as a tractor, truck, four wheel drive road vehicle or the like.

Figure 5:
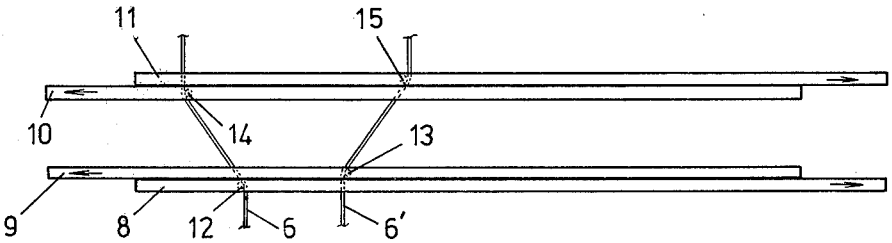
FIG. 5 shows a plan view with other parts of the machine omitted for clarity, of the deflecting bars.

The frame carries the wire coils 5 (only one of which is shown) from which the wire 6 is threaded through the pretensioning rollers 7 past the deflecting bars 8, 9, 10, 11 carrying deflecting pegs 12,13,14,15 (FIG. 5). The posts 16 are held in a magazine 17, the posts 16 being presented to and attached to the wire 6, and while so attached are fed through the tensioning rollers 18,19 whose rotation is restricted by a break (not shown).

The wires 6 are anchored at the end of the fence line, and as the machine is drawn therealong, the wires are tensioned by passing over and between the rollers 18 and 19 so that the tensioned fence with the steel posts attached is laid along the ground.

Figure 1:
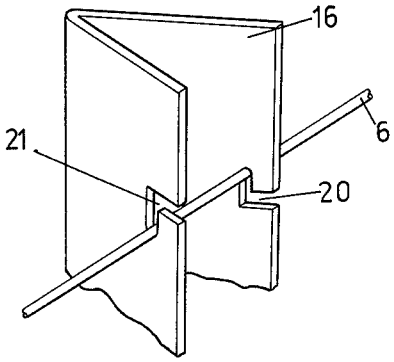
FIG. 1 shows part of a V-section post or dropper with a wire located in off-set slots.

As shown in FIG. 1, each post 16 is provided with a pair of oppositely directed notches, with the inner edges of the notches being slightly out of alignment, so that when a wire is inserted therein a wire is locked in position by being slightly kinked or deflected. The notches on each post may include some pairs which are displaced or formed with their misalignement in the opposite direction, so that the post will thus be locked to the wires.

FIG. 5 shows two wires 6 and 6' with each being oppositely kinked for presentation to opposite pairs of slots.

One pair of deflecting bars 8 and 10 with pegs 12 and 14 are used for deflecting the wire 6 in one direction, while a further pair of bars 9 and 11 with pegs 13 and 15 are used for deflecting the wire 6' in the opposite direction, the bars being moved as shown by the arrows in FIG. 5 to deflect the wires.

The bars are deflected by cams on a cam wheel 22, cam ramp 23 acting through roller 24 and pusher 25 and cross bar 26 having hooks 27 to engage the arms 28 and 29 on the bars 8 and 11 respectively to move these to the left as shown in the figures. The cam wheel 22 also has a cam ramp 30 also acting through a roller and pusher 31 and cross bar 32 to engage arms on the bars 9 and 10, arm 33 on the bar 9 only being shown.

The pairs of bars 8,11 and 9,10 are biased by springs (not shown for clarity) to their return position, rubber blocks 34 cushioning the spring return of the bars under the influence of the springs, and to prevent the complete return for a short period of time as will be later described.

Figure 2:
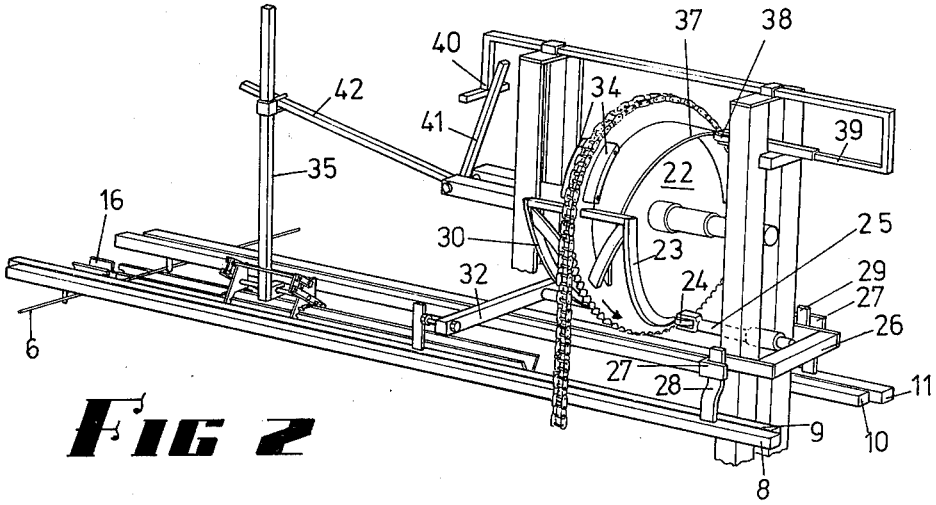
FIG. 2 shows a perspective view of portion of the machine with a post being lifted to be presented to the wires, only one wire being shown for clarity.

FIG. 2 shows a post 16' being lifted up to be presented to the wires by a lifter 35 having a grab 36, the lifter 35 being actuated by a cam ramp 37 acting through a roller 38 and pusher 39 having an arm 40 engaging a crank 41 to the other arm 42 of which lifter 35 is engaged.

Figure 3:
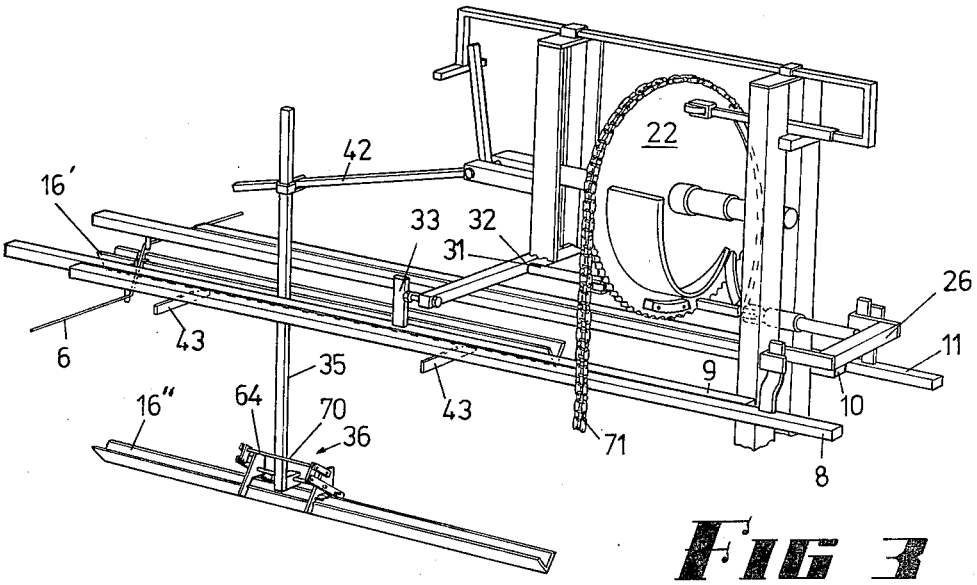
FIG. 3 shows a view similar to FIG. 2 with the wire kinked and engaged in the slot, and the position of the lifter later in the sequence to lift a further dropper.

FIG. 3 shows the condition where the lifter 35 has moved back downwardly to be ready to pick up another post 16", the post 16' being held and presented to the wires by platforms 43 with the bars 8,11 and 9,10 having their maximum displacement so that the platforms 43 hold the post in position so that the wires 6,6' are engaged in the slots of the post.

The platforms 43 are resiliently biased to hold the posts 16 in the correct position against the wires. The platforms 43 are actuated by one of the bars, such as bar 10 having an upstanding arm 44 engaging a stop on a rod 45 slideable in fixed frame 46 which has a pull rod 47 acting through spring 48 on an arm 49 attached to a pivot rod 50 to turn a further lever 51. Lever 51 turns a further lever 52 through rod 53, lever 52 being operatively connected to the platform 43.

Hence after the lifter 35 lifts the post 16' the platforms then engage the underside of the post in notch 54, thus causing the grab to disengage so that it can again be lowered to lift the next post 16".

As noted above when the bars return to their rest positions when their respective rollers roll over the ends of the cams 23 and 30 the pegs 12, 13, 14, 15, allow the wires to tend to straighten and so be locked in the slots in the posts. It is realised that all this time the wires are moving through the machine, for the wires are anchored and the machine moves forward. However as the deflections in the wires are released, the wires grab the posts, and the posts move rearwardly of the machine with the wires.

In order to allow free movement of the posts with the wires, means are provided to ensure that the posts do not foul against the pegs 14, 15 on the rear bars 10,11. This is accomplished by means effective to raise the bars 10,11 and hold them raised during the time that the parts move away from the kinking zone.

Referring to FIG. 7, on the frame 46 of the machine there are provided pivoted latches 55, 56 these being joined by levers 57, 58 interconnected by a spring 59 to bias the latches 55, 56 into the position shown, that is downwardly onto the frame member 46. Each of the bars 10,11 is provided with an upstanding frame 60,61 carrying protruding rods 62, 63.

As the bars 10,11 move during the deflecting operation the protruding rods pass under the latches which then move back to the position shown.

When the bars return for release of the deflecting pegs 12, 13, 14, 15, the protruding rods 62,63 ride up onto the latches 55, 56 so lifting the bars 10,11 to allow the posts to clear the pegs.

As described above when the respective rollers move off the ramps 23,30, the rollers strike the rubber blocks 34 to cushion the return movement. Hence the blocks 34 also prevent full return of the bars, and the blocks 34 cause the protruding rods 62,63 to be held on top of the latches 55,56 so that the bars 10,11 are held up for a short period of time to allow the posts to clear.

It is to be realised that FIG. 7 shows one end only of the bars 10,11 and a further pair of latches are provided to raise the other end of the bars 10,11. Similarly various pairs of deflecting pegs are provided depending upon the number of wires to be provided in the fence.

Figure 6:
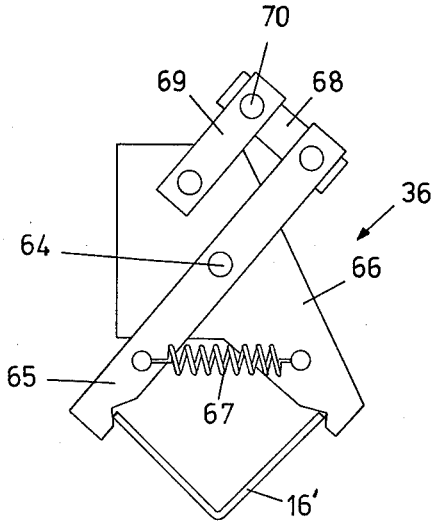
FIG. 6 shows the grab for lifting a post.
Figure 1:
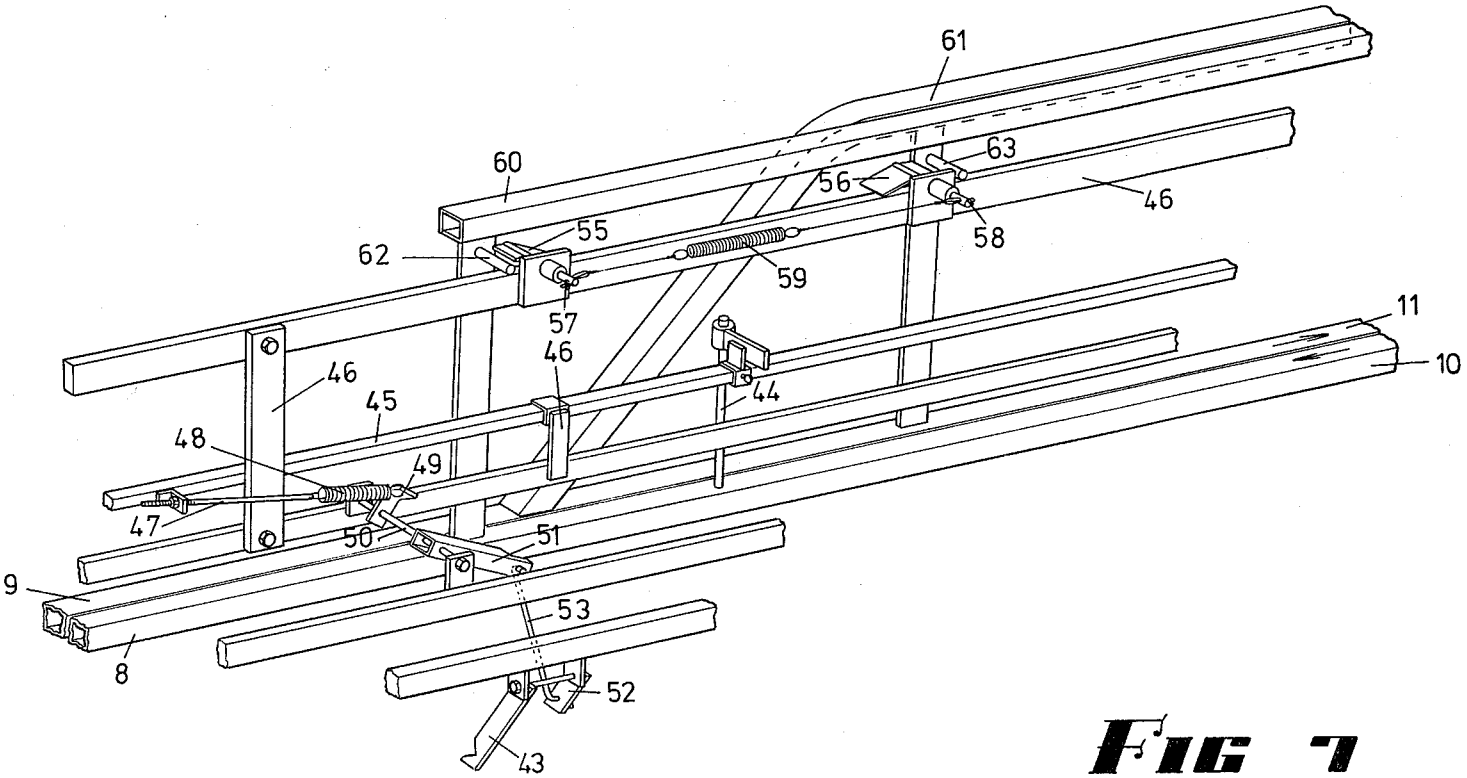

As shown in FIGS. 2,3 and 6, a grab 36 is provided to lift the posts 16. The grab 36 has a pivot axle 64 carrying a pivot jaw 65 and a jaw plate 66 which are biased tending to close the jaws by a spring 67 so that when the grab moves downwardly the jaws automatically grab and lift the next post 16'. The pivot jaw 65 extends upwardly and is pivoted by links 68,69 to the jaw plate 66.

Figure 4:
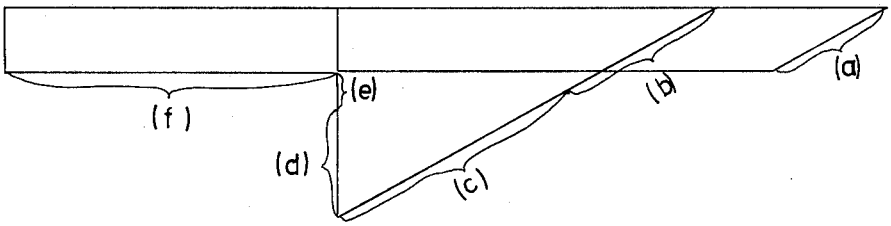
FIG. 4 shows a diagrammatic sequence of the operations.

A release pivot rod interconnects two ends of the grab 36 and when the lifter 35 lifts grab 36 and post 16' to the upper position, the platforms then engage the post 16' as previously described. These platforms push the post and grab upwardly so that the upper part of the grab, that is either link 68,69 or rod 70 contacts part of the frame of the machine and this then releases the grab 36 and the lifter is then allowed to descend as desired. It will be realised that the sequence of timeing of operations is critical for operation of the machine and a simplified diagram is shown in FIG. 4. Portion (a) shows the post being raised from the magazine to the raised position and (b) shows the support for the post is taken over from the grab by the platforms holding the post firmly in engagement with the wires. Portion (c) refers to the grab being disengaged and the wires are deflected for presentation to the slots. Portion (d) shows the release of the deflection, and at this time also the wires engage in the slots, the rear bars are raised to clear the pegs to allow passage of the dropper. At the time (e) the platforms under the posts are released, and also at (f) the rear bars are held upward to ensure clearance of the post, and finally the bars return to their lowered position.

The tensioning rollers 18,19 have the wires and droppers passing between the rollers, and as the machine is drawn forward, it is this passage of the wires therebetween which causes the rollers to rotate. The rollers 18,19 are geared together and roller 18 drives by a chain 71 and guide sprocket 72,73 the cam wheel 22. The tension rollers 18,19 have spiral rods thereon the grip the wires and ensure that an even tension is applied.

Appropriate spiral rods are suitably formed to provide a gap or slot to allow the passage of the post between the rollers. As the mechanism is driven from the tensioning rollers, the timing is easily accomplished.

The wire 6 is fed from the wire coil 5 through a wire feeder 74. The wire 6 is fed from the outside of the stationary horizontal coil, upwardly about a stationary guide ring 75 and down through a central guide ring 76, thus then passing downwardly through the coil 5 to guides to lead the wire to the pretensioning rollers. During operation the loop of wire as shown will turn and rotate about the ring 75 as it unwinds from the coil 5.

One of the tensioning rollers 18,19 is provided with a friction brake so that the tension of the wires and fence can be adjusted as desired, the rollers 18,19 being geared together. At the end of the fence line the wires are then tied off onto a post. When short runs only are to be made, it may be preferred to run the wires out at little or no tension with the brake released, utilising only the pretensioning rollers. On completion of the run, the brake could then be fully applied and the machine driven forward to fully tension the wires. Also the wires can be tied off onto a separate tie-bar, which is then attached to the machine and driven forward to tension the wires. The tensioned wires and the posts are then stood upright and tied off on main posts to complete the erected fence.

Throughout the specification where reference is made to posts being fed by the machine attached or locked to the tensioned wires, it is to be realised that this term includes within its scope droppers, spreaders or the like, whether made of steel or other material, and whether of V or star shape, as long as the posts or the like have slots through which the wires can pass and be locked and tensioned thereto.

It will be noted that the lifter is lifted by the cam operated lever and is allowed to fall by gravity to pick up the next post. In this way a simple control, either manual or automatic may be utilised to engage the lifter and not allow it to drop until the next post is required, and if the lifter is held upwardly, then the cam operated lever can thus move freely without actuating the lifter itself. Hence full control of the number and spacing of the posts is available.

I claim:

1. A fencing machine for producing a fence along a fence line, said machine being adapted to be moved along the fence line and including means for feeding at least a plurality of wires from reels of wire, said free ends of the wires being attached to anchor means at the begining of the fence line, means for tension said wires, means for presenting posts having offset slots to the wires, and means for deflecting the tensioned wires to enable the wires to enter into and be locked into the slots.

2. A fencing machine as defined in claim 1 characterised in that the deflecting means comprises a pair of bars transverse to the wires, said bars carrying deflecting pegs so that on movement of the bars in opposite direction the wires are deflected to be presented to the slots of the post.

3. A fencing machine as defined in claim 1 characterised in that the deflecting means is driven in timed relation to the passage of the wires through the machine.

4. A fencing machine as defined in claim 1 characterised in that the wires pass through tensioning rollers which are braked by an adjustable brake, said wires driving the tensioning rollers which are connected to drive a cam wheel in turn actuating the deflecting means which are movable in opposite directions to deflect the wires.

5. A fencing machine as defined in claim 1 characterised in that the posts are V-shaped with opposite slots in the edges of the V section, said posts being held in a magazine beneath the wires, a lifter actuated by a cam wheel driven in timed relation to the passage of the wires to lift and present the post to the wires.

6. A fencing machine as defined in claim 1 characterised by platforms to engage the undersurface of the post to resiliently hold the posts against the wires so that on deflection the wires enter the slots.

7. A fencing machine as defined in claim 1 characterised by two pairs of bars whereby the various wires can be oppositely kinked to enter oppositely directed slots whereby the post is locked to the wires.

8. A fencing machine as defined in claim 1 characterised by bars transverse to the wires carrying pegs deflecting the wires on opposite movements of the bars, means for moving said bars to deflect the wires, and release said bars for return movement to cause said wires to be locked to said posts whereby the post moves with the wires, and means to lift the rear bars to allow the posts passage from the deflecting position.

9. A fencing machine as defined in claim 1 characterized by wire feeder means comprising a holder for a coil of wire, means for feeding the wire from a stationary horizontal coil in said holder comprising a guide ring situated above the coil, and a central guide ring to direct the wire downwardly through and out underneath the coil of wire.

* * * * *